US006565427B2

(12) United States Patent
Kuwabara et al.

(10) Patent No.: US 6,565,427 B2
(45) Date of Patent: May 20, 2003

(54) COIN PAY-OUT DEVICE

(75) Inventors: Toshitomo Kuwabara, Kiryu (JP); Tetsuya Mashimo, Kiryu (JP); Hideaki Yanagisawa, Tano-gun (JP)

(73) Assignee: Sanden Corporation, Gunma (JP)

( * ) Notice: Subject to any disclaimer, the term of this patent is extended or adjusted under 35 U.S.C. 154(b) by 48 days.

(21) Appl. No.: 09/881,210

(22) Filed: Jun. 15, 2001

(65) Prior Publication Data

US 2002/0189918 A1 Dec. 19, 2002

(30) Foreign Application Priority Data

Jun. 15, 2000 (JP) ..... 2000-179721

(51) Int. Cl.[7] ..... G07D 1/02
(52) U.S. Cl. ..... 453/21
(58) Field of Search ..... 453/20, 21, 23

(56) References Cited

U.S. PATENT DOCUMENTS 2,796,876 A * 6/1957 Gabrielsen ..... 221/243
4,284,093 A * 8/1981 Hayashi ..... 453/21
5,538,469 A * 7/1996 Kwon et al. ..... 453/21
6,176,773 B1 * 1/2001 Mikami et al. ..... 453/21

FOREIGN PATENT DOCUMENTS

JP 11-161825 6/1999

* cited by examiner

*Primary Examiner*—Kathy Matecki
*Assistant Examiner*—Michael J. Kwon
(74) *Attorney, Agent, or Firm*—Banner & Witcoff, Ltd.

(57) ABSTRACT

In a coin pay-out device to which the present invention is applied, the rotary arm of the second change slide is extended to a space between adjacent first change slides and the rear end side of the rotary arm is used as a stopper for disabling the rotation of the rotary arm. Consequently, it is possible to dispose the solenoids of the second change slide and the solenoids of the first change slides side by side. As a result, the disposition space of each solenoid can be reduced both in the transverse direction, as well as in the front-rear direction, thereby the whole size of the coin pay-out device can be reduced. Furthermore, because the second change slide is the rotary arm that turns around the fixed supporting member having a movable supporting member at its tip, which is to be fit in the guide groove of the pay-out link, the second change slide is simplified in structure.

16 Claims, 4 Drawing Sheets

COIN PAY-OUT DEVICE

CROSS-REFERENCE TO RELATED APPLICATION

This application is based upon and claims the benefit of priority from the prior Japanese Patent Application No. 2000-179721, filed Jun. 15, 2000, the entire contents of which are incorporated herein by reference.

BACKGROUND OF THE INVENTION

1. Field of the Invention

The present invention relates to a coin pay-out device that is a component of a coin mechanism in a vending machine or the like, more particularly, to an improved version of a coin pay-out device that pays out change, which is such large coins as the 500-yen coin.

2. Description of the Prior Art

Each vending machine incorporates a coin mechanism that processes coins loaded therein. Such a vending machine is provided with some components such as a coin discriminating unit that discriminates between true and false coins, as well as between coin types; a coin storage having some coin tubes that hold coins decided as true ones for each coin type; and a coin pay-out device that pays out coins from those tubes as change.

Among those components of a vending machine, various types have been proposed for the coin pay-out device; one of them is disclosed in Japanese Patent Application Laid-Open No.11-161825.

The coin pay-out device disclosed in the JP-A-11-161825 is provided with a pay-out slide that puts the bottom coin in each coin tube into the coin holding hole and a plurality of first change slides facing a coin holding hole of the pay-out slide respectively. A pay-out link connected to a driving power source drives both of the pay-out slide and each first change slide so that they make bi-directional movements. The pay-out slide is disposed on a base, so that each coin holding hole is closed by the top surface of the base when the pay-out slide stands by, thereby the bottom coin is not paid out. When a coin is to be paid out, both of the pay-out slide and each change slide go back so that each coin holding hole goes onto the corresponding pay-out hole, thereby coin(s) are paid out from the coin pay-out hole.

On the other hand, the coin pay-out device is provided with a plurality of stopper mechanisms (solenoids), each of which disables the bi-directional movement of the corresponding first change slide selectively. Each solenoid is turned on/off so as to cross a stopper pin onto the movement line of a first change slide, thereby disabling the backward movement of the first change slide.

Consequently, in the case where each first change slide is disabled in movement as described above, the first change slide does not move even when the pay-out slide goes back, thereby each coin holding hole goes onto the corresponding first change slide. This is why each coin holding hole is closed by the corresponding first change slide, so that no coin is paid out from the coin pay-out hole.

As described above, when a coin is to be paid out, it is just required to reset the movement of only the first change slide corresponding to the selected money type. Consequently, only the selected coin(s) can be paid out as the change.

It is true that the first change slide as described above is structured so as to dispense coins effectively only in such coins as 10-yen, 50-yen, and 100-yen, sizes of which are almost same. For very large diameter coins such as the 500-yen coin when compared with other coins, however, the coin holding hole becomes large in accordance with the diameter. A change slide disposed at the rear side of a coin holding hole must also be disposed more closely towards the rear side than other coin change slides. As a result, the front-rear width of the coin pay-out device is increased, suffering from an increase of the coin pay-out device in whole size.

In order to solve the problem, the coin pay-out device disclosed in the JP-A-11-161825 employs a second change slide, structured differently from that of the first change slide, as a pay-out member of the 500-yen coin.

This second change slide is structured to have a slide body formed like a rectangular plate, and a cam shaft being protruded from the rear end of the top surface of this slide body. On the other hand, an elastic rotary shaft is protruded downward from around the center of the back surface of the slide body. The pay-out link is provided with a bearing hole that fixes this rotary shaft rotationally and a guide groove that fits the rotary shaft therein removably. In addition, an arcuate cam groove is formed in an upper cover that covers the top surface of the pay-out link so as to guide the cam shaft transversely.

In the case of this second change slide, the cam shaft thereof moves transversely in the cam groove of the second change slide when the pay-out link goes back and the movement of this cam shaft makes the second change slide rotate transversely around the rotary shaft. Consequently, the second change slide is moved so as to open the coin pay-out hole, thereby the bottom 500-yen coin is paid out from the coin pay-out hole.

On the other hand, when the cam shaft of the second change slide is disabled in movement by the stopper pin of the solenoid, the pay-out link goes back, thereby the rotary shaft is guided by the guide groove of the pay-out link so as to be removed from the pay-out link. The second change slide thus stands by on the coin pay-out hole. Consequently, the coin pay-out hole that has moved back is closed by the second change slide, so that the 500-yen coin in the coin holding hole is held by the second change slide. Thus, no coin is paid out from the pay-out hole.

The structure of the conventional coin pay-out device as described above that rotates the second change slide so as to dispense a 500-yen coin prevents the coin pay-out device from increasing in its front-rear width.

In this second change slide, however, the solenoid that disables the movement of the second change slide disables the movement of the cam shaft at the rear end of the second change slide, so that this solenoid is disposed more backward than the solenoid that disables the movement of the first change slide, causing the size of the coin pay-out device to be increased.

Further, a solenoid is disposed at the rear of each change slide extended in the front-rear direction, so that the solenoids are disposed unavoidably along all the entire change slides disposed side by side transversely. As a result, the disposition space of all the solenoids is increased unnecessarily, thereby the space efficiency of those solenoids is lowered.

In addition, the rotary shaft of the second change slide is fixed when a coin is paid out. When no coin is paid out, the rotary shaft is movable. Consequently, a bearing hole and a guide groove must be formed at the pay-out link respectively so as to fix the rotary shaft when it functions as a fixed shaft and guide the rotary shaft when it functions as a movable shaft. In addition, a cam groove that guides the cam shaft must be formed at the upper cover. Thus, the structure of the second change slide becomes very complicated.

SUMMARY OF THE INVENTION

It is an object of the present invention to provide a compact coin pay-out device that employs a simply-structured second change slide so as to improve the space efficiency of the stopper mechanism.

A present invention provides a coin pay-out device comprising a pay-out link being connected to a driving power source and enabled to make a back and forth bi-directional movement; a pay-out slide that puts the bottom coin in each coin tube into the corresponding coin holding hole and makes a back and forth bi-directional movement by following the bi-directional movement of the pay-out link; a plurality of first change slides disposed side by side transversely, each of the first change slides being enabled to make a bi-directional movement by following the bi-directional movement of the pay-out link; a second change slide adjacent to each of the first change slides and enabled to rotate back and forth by following the bi-directional movement of the pay-out link; and a plurality of stopper mechanisms, each of which being disposed at the side of a first change slide so as to disable both bi-directional movement and rotation of the change slide selectively. When no coin is to be paid out, each stopper mechanism is set so as to advance the change slide under the corresponding coin holding hole, thereby disabling the coin pay-out. When a coin is to be paid out, each stopper mechanism is reset so as to make the corresponding change slide retreat from under the coin holding hole, thereby the coin is paid out. The second change slide is provided with a rotary arm extended towards a space between adjacent first change slides and enabled to go back and forth under the bottom surface of the coin holding hole. At the tip side of the rotary arm is provided a movable supporting member to be fit removably in a guide groove of the pay-out link. At the rear end side of the rotary side is provided a stopper whose rotation is disabled by a stopper mechanism. And, a fixed supporting member is provided between the movable supporting member and the stopper of the rotary arm.

According to the present invention, therefore, when a coin is paid out by the second change slide, the stopper of the rotary arm resets the stopper mechanism so as to enable the rotation. Then, the pay-out link is moved back. Consequently, the coin holding hole goes back and comes onto the top surface of the coin pay-out hole. On the other hand, when this pay-out link goes back, the movable supporting member moves along the guide groove, thereby the rotary arm rotates around the fixed shaft.

Due to the rotation of this rotary arm, the tip of the rotary arm rotates to the rear side. Thus, the tip of the rotary arm is kept separated from the coin holding hole, thereby the coin holding hole is not closed. Coins are thus paid out from the pay-out hole.

On the other hand, when no coin is paid out by the second change slide, each stopper mechanism disables the rotation of the corresponding stopper of the rotary arm. When the pay-out link goes back so as to dispense another coin, the coin holding hole of the pay-out slide goes back onto the top surface of the coin pay-out hole. On the other hand, the rotation of the second change slide is disabled, so that the movable supporting member of the rotary arm is disengaged from the guide groove due to the backward movement of the pay-out link. The second change slide is thus extended so as to keep standing by on the top surface of the coin pay-out hole. Consequently, the coin holding hole that has moved to the coin pay-out hole is closed by the second change slide. Coins in the coin holding hole are thus held by the second change slide and no coin is paid out in this state.

In this case, the fixed supporting member may be disposed outside the pay-out link. The movable supporting member may have an elastic projection and this projection may be fit in the guide groove of the pay-out link.

According to the present invention, it is possible to dispose each stopper mechanism of the second change slide so as to be ganged with the stopper mechanism of each first change slide. Thus, the disposition space of each stopper mechanism can be reduced more in the transverse direction, as well as in the front-rear direction, thereby the whole size of the coin pay-out device can be reduced more.

Furthermore, there is no need to form a plurality of guide grooves that are required for the conventional coin pay-out devices. Therefore, the second change slide is more simplified in structure.

The above described objects, other objects, features, and benefits of the present invention will be apparent by the following description and attached drawings.

DESCRIPTION OF THE PREFERRED EMBODIMENTS

Hereunder, the preferred embodiments of the present invention will be described with reference to the accompanying drawings.

Figure 1:
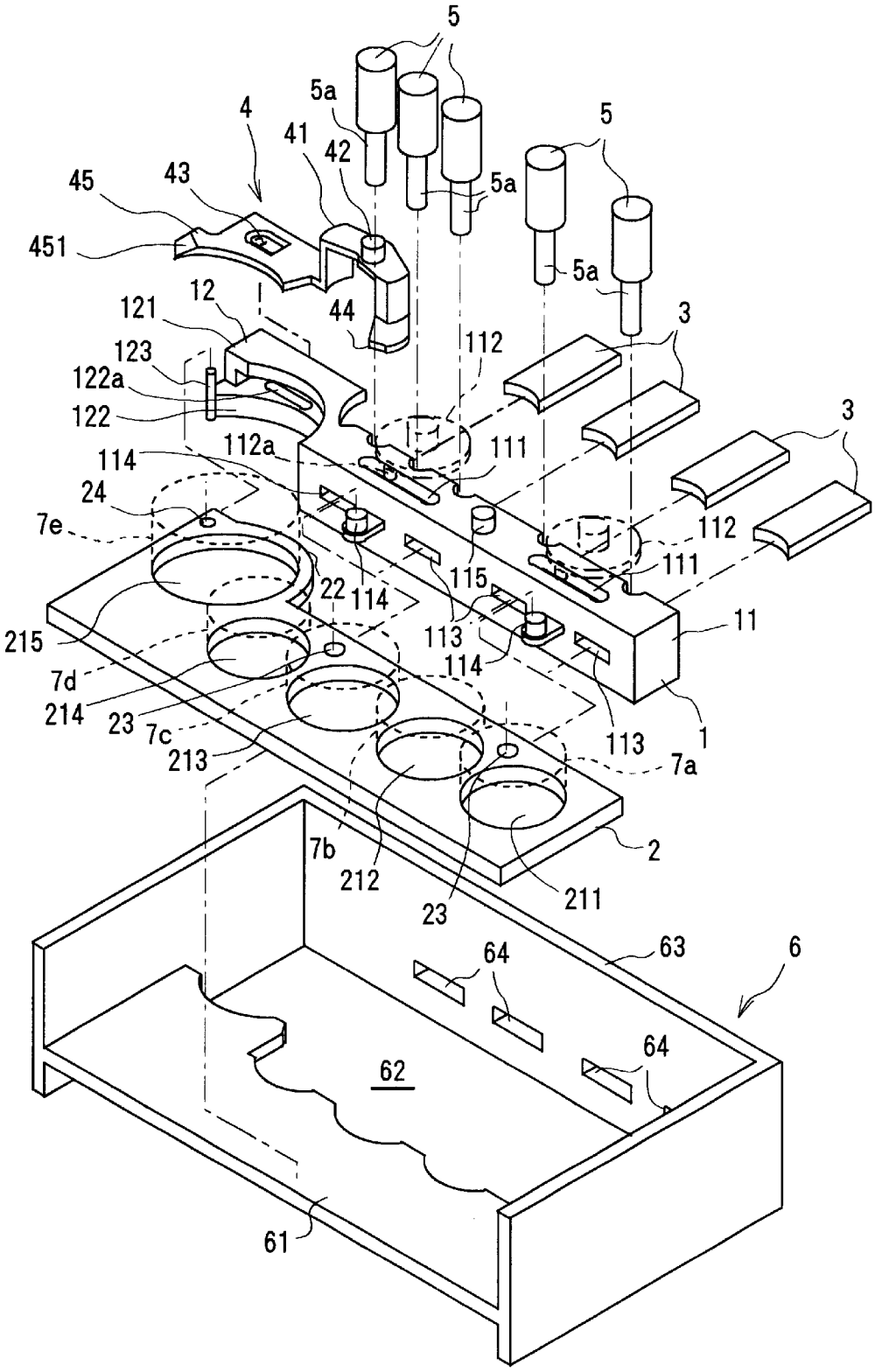
FIG. 1 is a perspective exploded view of a coin pay-out device of the present invention.

FIGS. 1 though 7 show the embodiment of the coin pay-out device of the present invention.

At first, the entire configuration of the coin pay-out device will be described. The coin pay-out device comprises a pay-out link 1 connected to a rotation driving source (motor not shown); a pay-out slide 2 connected to the pay-out link 1; a plurality of first change slides 3, each of which moves by following the pay-out link 1; a second change slide 4 that moves by following the pay-out link 1; a plurality of stopper mechanisms (solenoid mechanisms) 5, each of which disables the movement of the change slides 3 and 4; and a base 6 that supports the pay-out slide 2.

This pay-out link 1 is configured by a square-pole-like first link member 11 extended transversely; and a second link member 12 extended outward from the left end of the first link member 11 (FIGS. 1, and 5 through 7).

This first link member 11 has a guide groove 111 extended transversely on its top surface. A projection 112*a* (shown by the dot line in FIG. 1) of a pay-out cam 112 (connected to the rotation driving source) is fit removably in this guide groove 111. Consequently, when the pay-out cam 112 rotates, the pay-out link 1 makes a back and forth bi-directional movement. The first Link member 11 also has plural (four) back and forth through-guide-holes 113 disposed transversely at intervals. A first change slide 3 is fit in each slide guide hole 113 removably in the back and forth direction. This slide guide hole 113 has a holding member that holds the first change slide 3 in itself so as to be engaged/disengaged freely. Usually, while the holding member holds the first change slide 3 as described above, the holder member releases the fast change slide 3 when the movement of the first change slide 3 to the rear side of the pay-out link 1 is disabled (by the stopper pin 5*a* of the solenoid mechanism 5 to be described later).

There are two connection pins 114 provided at the front side of the first link member 11. Each connection pin 114 is connected to a connection hole 23 of the pay-out slide 2. In the center of the top surface of the first link member 11 is provided a supporting shaft 115 of the pay-out link 1. This supporting shaft 115 is supported on a top cover (not shown) movably back and forth.

The second link member 12 is formed so that upper and lower plates 121 and 122 are disposed at an interval and the second change slide 4 is put between them 121 and 122. Each of the upper and lower plates 121 and 122 has an arcuate notch on the front side so as to correspond to the arcuate surface of the projection 22 of the pay-out slide 2 to be described later. The lower plate 122 of the second link member 12 has a guide groove 122*a* extended transversely. A projection 432 (to be described later) of the second change slide 4 is fit in this guide groove 122*a* and this projection 432 is guided transversely. At the front left end of the lower plate 122 is provided a connection pin 123 extended upward. This connection pin 123 is connected to the connection hole 24 of the pay-out slide 2.

The pay-out slide 2 is a rectangular plate and has a plurality of coin holding holes, each of which goes through in the vertical direction disposed transversely. For example, 100-yen coin holding holes 211 and 212, a 10-yen coin holding hole 213, a 50-yen coin holding hole 214, and a 500-yen coin holding hole 215 are formed sequentially from right to left. The 500-yen coin holding hole 215, since it is large in diameter, has an arcuate portion 22 protruded towards the rear side so as to accept this large diameter. The 500-yen coin holding hole 215 is thus extended up to this protruded portion 22. As shown with broken lines, the coin holding holes 211 to 215 communicate with coin tubes 7*a* to 7*e* for stocking each type change coins respectively, so that each coin holding hole holds the bottom coin in each of the coin tubes. The pay-out slide 2, as described above, is formed so that the connection pins 114 and 123 of the pay-out link 1 are connected to the connection holes 23 and 24 respectively, thereby the pay-out slide 2 makes a back and forth bi-directional movement by following the bi-directional movement of the pay-out link 1.

Figure 5:
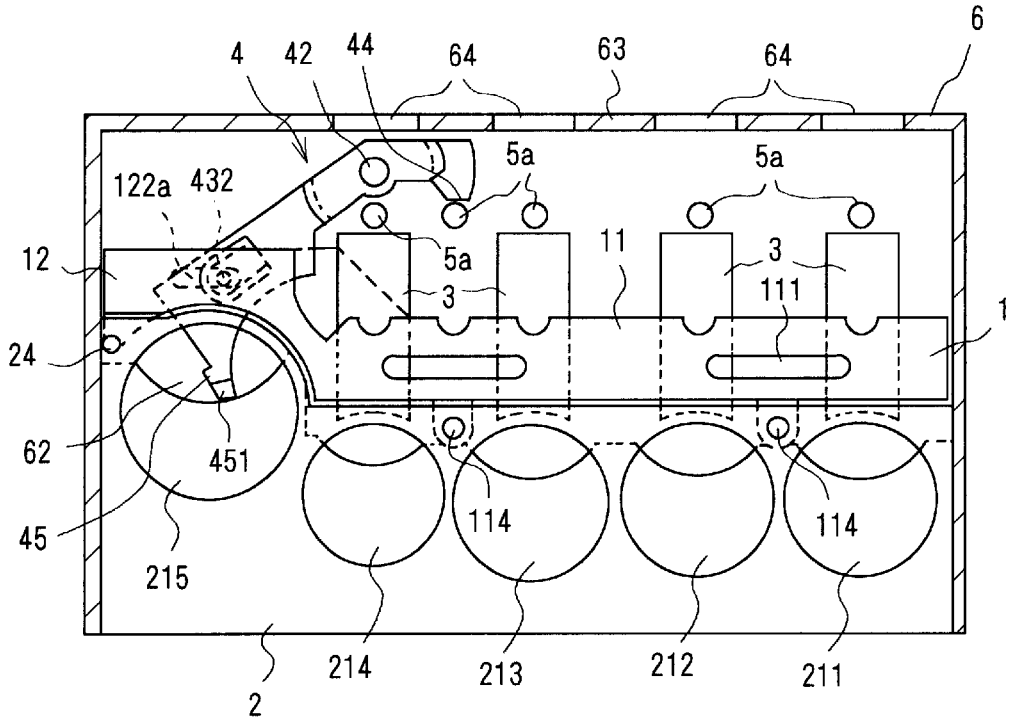
FIG. 5 is a top/cross sectional view of the coin pay-out device in the standby state.
Figure 6:
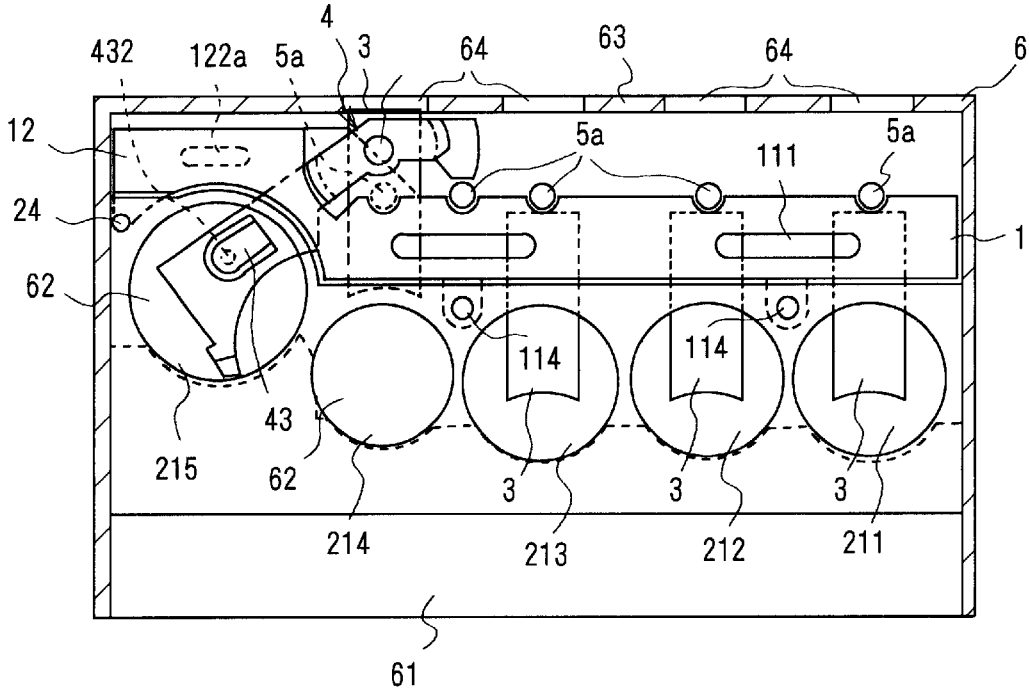
FIG. 6 is a top/cross sectional view of a second change slide when no coin is paid out.
Figure 7:
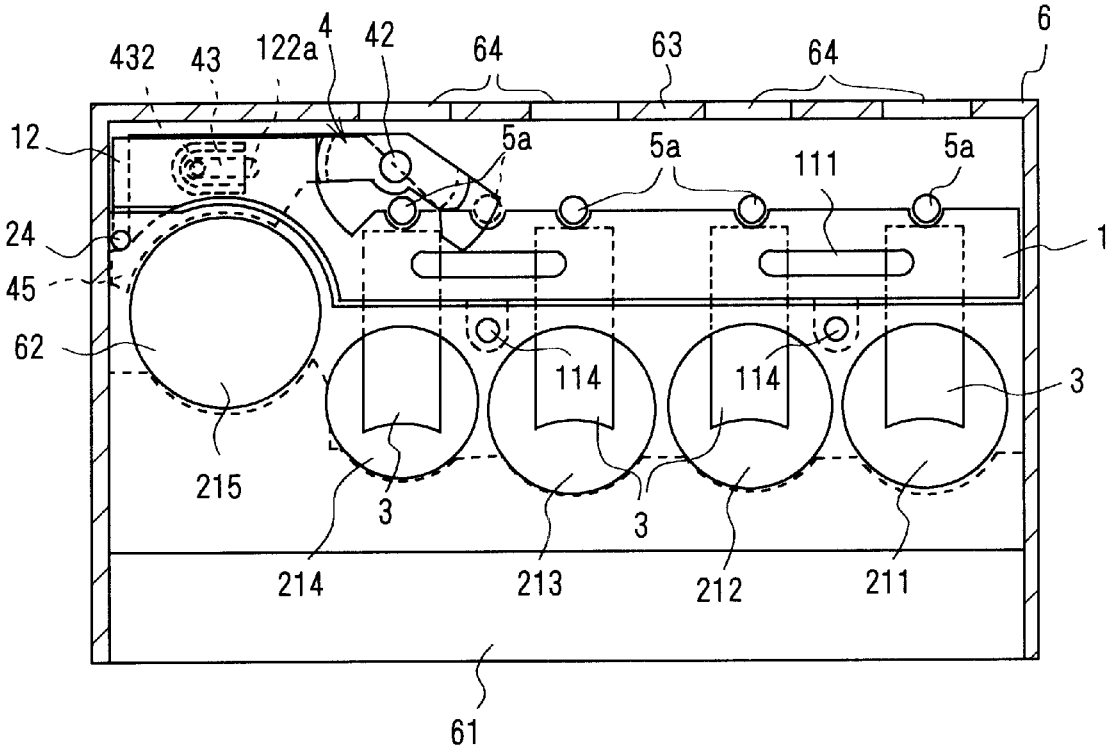
FIG. 7 is a top/sectional view of the second change slide when a coin is paid out.

Each first change slide 3 goes through one of the slide guide holes 113 of the pay-out link 1 as described above. Each first change slide 3 is disposed so as to face its corresponding coin holding hole 211 to 214 as shown in FIGS. 5 through 7. When the pay-out slide 2 goes back, each first change slide 3 that is disabled in movement by a stopper comes under the bottom surface of the corresponding coin holding hole 211 to 214 as shown in FIG. 7.

The second change slide 4 has a rotary arm 41, which is almost V-form when taking a view from above (FIGS. 5 through 7). A portion between the front end and the rear end, that is, between both ends of the rotary arm 41 is formed to rise up as shown in FIG. 1. On the top the portion is protruded a fixed supporting member 42 by which the upper cover (not shown ) is fixed rotationally. This fixed supporting member 42 is disposed outside the pay-out link 1.

Figure 2:
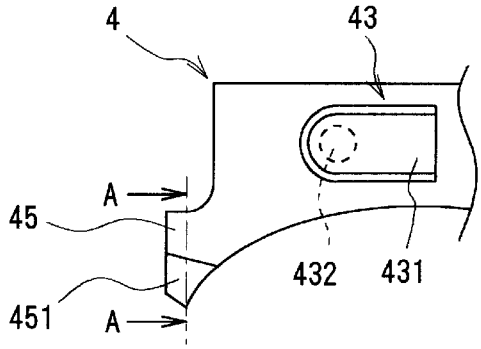
FIG. 2 is a top view of a movable supporting member of a second change slide.
Figure 3:
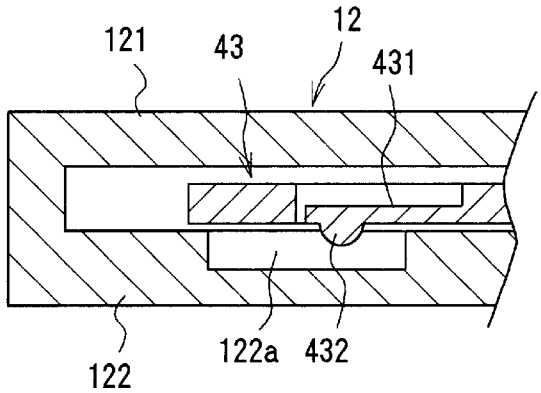
FIG. 3 is a cross sectional view showing how the movable supporting member is fit in the groove, as well as a projection structure of the second change slide of the second change slid.
Figure 4:
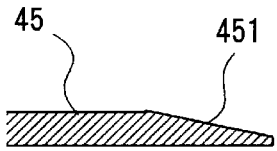
FIG. 4 is a cross sectional view of the projection of the second change slide (at the A—A line in FIG. 2).

At the tip of the rotary arm 41 is provided a movable supporting member 43. This movable supporting member 43, as shown in FIG. 2, has an almost U-shaped Through-slit formed through the rotary arm 41. The movable supporting member 43 also has a thin elastic piece 431 as shown in FIG. 3. On the lower surface of the tip of this elastic piece 431 is formed a hemispherical projection 432 as shown in FIG. 3. This projection 432 is fit in the guide groove 122*a* of the second link member 12. The tip of the rotary arm 41, as shown in FIGS. 5 and 6, is extended from the rear side of the 500-yen coin holding hole 215 so as to be aligned to the front fringe when no 500-yen coin is paid out. Consequently, the 500-yen coin in the coin holding hole 215 is supported. In addition, at the tip of the rotary arm 41 is extended a projection 45 protruded outward as shown in. FIG. 2. The top surface of the tip of this projection 45 forms a portion 451 tapered towards the end surface as shown in FIG. 4. On the other hand, the rear end of the rotary arm 41 is extended towards a space between adjacent first change slides as shown in FIGS. 5 through 7 and the outer surface of this rear end functions as a stopper 44. This stopper 44 is disposed so that the stopper pin Sa of the solenoid 5 comes in contact therewith. Consequently, the 500-yen coin in the coin holding hole 215 is supported. In addition, at the tip of the rotary arm 41 is extended a projection 45 protruded outward as shown in FIG. 3. The top surface of the tip of this projection 45 forms a portion 451 tapered towards the end surface as shown in FIG. 4. On the other hand, the rear end of the rotary arm 41 is extended towards a space between adjacent first change slides as shown in FIGS. 5 through 7 and the outer surface of this rear end functions as a stopper 44. This stopper 44 is disposed so that the stopper pin 5*a* of the solenoid 5 comes in contact therewith.

The solenoids 5, as shown in FIG. 1, are disposed at the stoppers of the four first change slides (the rear end face of each first change slide 3) and above the stopper 44 of one second change slide 4 respectively. Each solenoid 5 moves the corresponding stopper pin 5*a* up/down so as not to move the first change slide 3 backward and not to rotate the second change slide 4 clockwise.

The base 6, as shown in FIG. 1, is formed like a square box whose top and bottom are opened. The front side functions as a supporting plate 61 for supporting the pay-out slide 2 movably. A portion of the base 6, which is not closed by the supporting plate 61, is used as a coin pay-out hole 62. The rear plate 63 of the base 6 has through-holes 64 corresponding to the first change slides 3. As shown in FIG. 6, each first change slide that goes backward by following the pay-out link 1 is guided into one of the through-holes 64.

Next, a description will be made for a coin pay-out operation of the coin pay-out device in this embodiment with reference mainly to FIGS. 5 through 7. At first, the standby state of the coin pay-out device will be described with reference to FIG. 5. Each of the coin holding holes 211 to 215 of the pay-out slide 2 is supported by the supporting plate 61 of the base 6. About three fourths of each coin holding hole 211 to 215 is closed by this supporting plate 61. This is why the bottom coin in each of the coin holding holes 211 to 215 (the bottom coin in each of the coin tubes 7*a* to 7*e*) is not paid out (standby state).

In the standby state, when a 50-yen coin is to be paid out, the solenoid 5 corresponding to the coin holding hole 214 is turned on (the leftmost solenoid 5 in FIG. 1 is excited so as to enable the movement of the first change slide 3). On the other hand, the solenoids 5 corresponding to other coin holding holes 211 to 213 and 215 are turned off and driven into the non-exciting state respectively. Then, a motor (not shown) is driven to let the pay-out link 1 make a back and forth bi-directional movement. Due to this backward movement of the pay-out link 1, the first change slide 3 corresponding to the 50-yen coin goes back and other first change slides 3 and the second change slide 4 are disabled for movement and rotation by the stopper pins 5*a* of the solenoids 5 respectively. Those first change slides 3 thus keep the standby state respectively. And, due to this backward movement of the pay-out link 1, the pay-out slide 2 also goes back and each of the coin holding holes 211 to 215 moves onto the corresponding coin pay-out hole 62.

Due to the movements of the change slides 3 and 4, as well as the movement of the pay-out slide 2 as described above, the coin holding hole 214 corresponding to the 50-yen coin is opened fully to the coin pay-out hole 62. On the other hand, other coin holding holes 211 to 213 are closed by the first change slides 3 respectively. When the pay-out slide 2 goes back, the projection 432 of the movable supporting member 43 is disengaged from the guide groove 122*a* of the pay-out link 1, thereby the second change slide 4 is held in the same state as the standby. Consequently, the coin holding hole 215 is closed by the second change slide 4. This is why only the 50-yen coin in the coin holding hole 214 opened fully is paid out as change. To dispense a 10-yen coin and a 100-yen coin, the solenoids 5 corresponding to those coins are turned on, thereby 10-yen and 100-yen coins are paid out as change just like the 50-yen coin described above.

Next, a description will be made for how to dispense a 500-yen coin with reference to FIG. 7. When a 500-yen coin is to be paid out, the solenoid 5 corresponding to the 500-yen coin holding hole 215 is turned on (the second solenoid 5 from the left in FIG. 1 is excited so as to enable the movement of the second change slide 4). On the other hand, the solenoids 5 corresponding to other coin holding holes 211 to 214 are kept off so as to drive them into the non-exciting state respectively. Then, a motor (not shown) is driven so as to let the pay-out link 1 make a back and forth bi-directional movement. Due to this backward movement of the pay-out link 1, the projection 432 of the movable supporting member 43 moves along the guide groove 122*a*, thereby the projection 432 turns clockwise around the fixed supporting member 42 as shown FIG. 7. On the other hand, the movement of each first change slide 3 is disabled by a stopper pin 5*a* and kept in the standby state as shown in FIG. 7. And, due to this backward movement of the pay-out link 1, the pay-out slide 2 also goes backward, so that coin holding holes 211 to 215 go onto the coin pay-out holes 62.

Due to the movements of the change slides 3 and 4, as well as the movement of the pay-out slide 2 as described above, the coin holding hole 215 corresponding to the 500-yen coin is opened fully to the coin pay-out hole 62. On the other hand, other coin holding holes 211 to 214 are closed by the first change slides 3 respectively. Consequently, only the 500-yen coin in the coin holding hole 215 opened fully is paid out as change.

In the case of the coin pay-out device in this embodiment, the rotary arm 41 of the second change slide 4 is extended to a space between adjacent first change slides 3 as shown in FIGS. 5 through 7, and the outer surface of this rear end side functions as a stopper 44. This stopper 44 comes in contact with the stopper pin 5*a* of the solenoid 5.

Consequently, as shown in FIGS. 5 through 7, the stopper pin Sa that disables the rotation of the second change slide 4 can be disposed between the first pin and the second pin from the leftmost pin of the stopper pins 5*a* which are used to disable the movement of a first change slide 3. Thus, as shown in FIG. 1, the solenoid 5 of each stopper pin 5*a* requires smaller disposition space in the fight-left direction. In addition, all the solenoids 5 can be disposed on a traverse line, thereby the size of the coin pay-out device in the front-rear direction can be reduced more than the conventional coin pay-out device.

Furthermore, the second change slide 4 is a rotary arm 41 that rotates around the fixed supporting member 42 as described above and the movable supporting member 43 to be fit in the guide groove 122*a* of the pay-out link 1 is provided at the tip. The second change slide 4 is thus simplified in structure more than the second change slide of the conventional coin pay-out device.

Furthermore, the tip of the rotary arm 41 is extended from the rear side of the coin holding hole 215 so as to be aligned to the front fringe when no 500-yen coin is paid out. The bottom 500-yen coin in the coin holding hole 215 is thus supported entirely in the front-rear direction, thereby it is possible to prevent the 500-yen coin from troubles including the coin lock one. While the coin holding hole 215 is closed by the second change slide 4 entirely in the front-rear direction in this embodiment, the same effect can also be obtained when the tip of the rotation arm 41 is extended up to around the front fringe of the coin holding hole 215.

Furthermore, the top surface of the tip of the second change slide 4 is tapered (lowered) gradually towards the end, so that the bottom 500-yen coin that moves onto the second change slide 4 is guided smoothly along the tapered surface 451 when the 500-yen coin corresponding to the second change slide 4 is not paid out (when the 10-yen, 50-yen, and 100-yen coins corresponding to the first change slides 3 are paid out). Thus, the 500-yen coin can also be prevented from troubles including the coin lock one.

What is claimed is:

1. A coin pay-out device, comprising:

a pay-out link that translates with bi-directional movement in a back direction and an opposite forward direction;

a pay-out slide that defines a plurality of coin holding holes that are configured to receive individual coins from a plurality of coin tubes, said pay-out slide being movable in the back direction and the forward direction by following said hi-directional movement of said pay-out link;

a plurality of first change slides disposed side by side in a right-left direction, said first change slides being movable in the back direction and the forward direction by following said bi-directional movement of said pay-out link;

a second change slide adjacent to at least one of said first change slides, said second change slide being rotatable in the back direction and the forward direction by following said bi-directional movement of said pay-out link; and a plurality of stopper mechanisms, each said stopper mechanism being located adjacent one of said first change slides and said second change slide so as to selectively disable movement of said first change slides and rotation of said second change slide;

wherein each of said stopper mechanisms has a first position and a second position, each said stopper mechanism preventing movement of a corresponding said change slide relative to a bottom surface of a corresponding said cam holding hole when in said first position, thereby disabling pay-out of the coin therefrom when no coin is to be paid out, and each said stopper mechanism permitting movement of the corresponding said change slide relative to said bottom surface of the corresponding said coin holding hole when in said second position, thereby enabling pay-out of the coin therefrom when the coin is to be paid out;

said second change slide includes a rotary arm enabled to go back and forth under said bottom surface of one of said coin holding holes;

a movable supporting member is provided at a tip of said rotary arm so as to be fit removably in a guide groove of said pay-out link;

a stopper member is provided at a rear end of said rotary arm so that the rotation is disabled by one of said stopper mechanisms; and a fixed supporting member is provided between said movable supporting member and said stopper member of said rotary arm.

2. The coin pay-out device according to claims 1;

wherein a top surface of said tip of said second change slide is tapered towards its end.

3. The coin pay-out device according to claim 1;

wherein said fixed supporting member is disposed outside said pay-out link.

4. The coin pay-out device according to claims 3;

wherein said movable supporting member has a projection to be fit removably in said guide groove of said pay-out link and an elastic member that presses said projection into said guide groove.

5. The coin pay-out device according to claims 4;

wherein said second change slide, when being moved under said bottom surface of the one of said coin holding holes and no coin is to be paid out, is extended from a rear side of the one of said coin holding holes so as to be aligned or close to a front fringe.

6. The coin pay-out device according to claims 5;

wherein a top surface of said tip of said second change slide is tapered towards its end.

7. The coin pay-out device according to claims 4;

wherein a top surface of said tip of said second change slide is tapered towards its end.

8. The coin pay-out device according to claim 3;

wherein said second change slide, when being moved under said bottom surface of the one of said coin holding holes and no coin is to be paid out, is extended from a rear side of the one of said coin holding holes so as to be aligned or close to a front fringe.

9. The coin pay-out device according to claims 8;

wherein a top surface of said tip of said second change slide is tapered towards its end.

10. The coin pay-out device according to claims 3;

wherein a top surface of said tip of said second change slide is tapered towards its end.

11. The coin pay-out device according to claims 1;

wherein said movable supporting member has a projection to be fit removably in said guide groove of said pay-out link and an elastic member that presses said projection into said guide groove.

12. The coin pay-out device according to claims 11;

wherein said second change slide, when being moved under said bottom surface of the one of said coin holding holes and no coin is to be paid out, is extended from a rear side of the one of said coin holding holes so as to be aligned or close to a front fringe.

13. The coin pay-out device according to claims 12;

wherein a top surface of said tip of said second change slide is tapered towards its end.

14. The coin pay-out device according to claims 11;

wherein a top surface of said tip of said second change slide is tapered towards its end.

15. The coin pay-out device according to claims 1;

wherein said second change slide, when being moved under said bottom surface of the one of said coin holding holes and no coin is to be paid out, is extended from a rear side of the one of said coin holding holes so as to be aligned or close to a front fringe.

16. The coin pay-out device according to claims 15;

wherein a top surface of said tip of said second change slide is tapered towards its end.

* * * * *

UNITED STATES PATENT AND TRADEMARK OFFICE

CERTIFICATE OF CORRECTION

PATENT NO. : 6,565,427 B2
DATED : May 20, 2003
INVENTOR(S) : Toshitomo Kuwabara et al.

It is certified that error appears in the above-identified patent and that said Letters Patent is hereby corrected as shown below:

Column 9,
Line 3, change “cam” to -- coin --.

Signed and Sealed this

Sixteenth Day of September, 2003

JAMES E. ROGAN
*Director of the United States Patent and Trademark Office*